US006447384B1

(12) United States Patent
Jansson

(10) Patent No.: US 6,447,384 B1
(45) **Date of Patent: *Sep. 10, 2002**

(54) JIG FOR GRINDING SHARP-EDGED TOOLS

(75) Inventor: Torgny Jansson, Lindesberg (SE)

(73) Assignee: Tormek AB, Lindesberg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/311,669

(22) Filed: May 13, 1999

(30) Foreign Application Priority Data

May 13, 1998 (SE) ..... 9801669

(51) Int. Cl.[7] ..... B27G 23/00; G01B 5/24; B24B 19/00

(52) U.S. Cl. ..... 451/369; 33/534; 33/613; 451/370; 451/404; 451/405

(58) Field of Search ..... 451/45, 28, 364, 451/365, 367, 368, 369, 370, 391, 403, 404, 405; 33/534, 613, 626, 628, 633, 530, 531, 532

(56) References Cited

U.S. PATENT DOCUMENTS 6,189,225 B1 * 2/2001 Jansson ..... 33/534

FOREIGN PATENT DOCUMENTS

JP 248887 * 1/2000

* cited by examiner

*Primary Examiner*—Timothy V. Eley
(74) *Attorney, Agent, or Firm*—John Lezdey & Assoc

(57) ABSTRACT

Jig for grinding sharp-edged tools. The jig consists of a housing in the form of a casing designed with a passage running through it whose at least one end is flat, plus a seat, also in the form of a casing designed with a passage running through it, located in the passage of the housing and lockable in this housing in an inclined position in relation to the passage in the housing, whereby the seat is provided with a clamping device (4) for firmly holding a tool that is to be ground so that it extends through the passage of the seat, and that the seat has such a length that one end of it extends out beyond the housing at the flat end of the housing.

7 Claims, 6 Drawing Sheets

JIG FOR GRINDING SHARP-EDGED TOOLS

FIELD OF THE INVENTION

The present invention concerns a jig for grinding sharp-edged tools such as chisels, gouges, parting tools etc.

SUMMARY OF THE INVENTION

The invention makes it possible to even grind bevelled chisels with an oval cross-section, which are normally very difficult to grind with precision, as the convex underside of the chisels cannot rest against the grinding support in an exact and stable manner.

With the help of the invention, the oblique angles of the tool are adjustable in a continuously variable manner for grinding.

These opportunities for grinding sharp-edged tools are possible through the invention having acquired the characteristics specified in the claims.

A jig with such an extensive range of functions is not previously known.

BRIEF DESCRIPTION OF THE DRAWINGS

The invention will be described in the form of examples with reference to the drawings, where.

DESCRIPTION OF THE PREFERRED EMBODIMENTS

Figure 1:
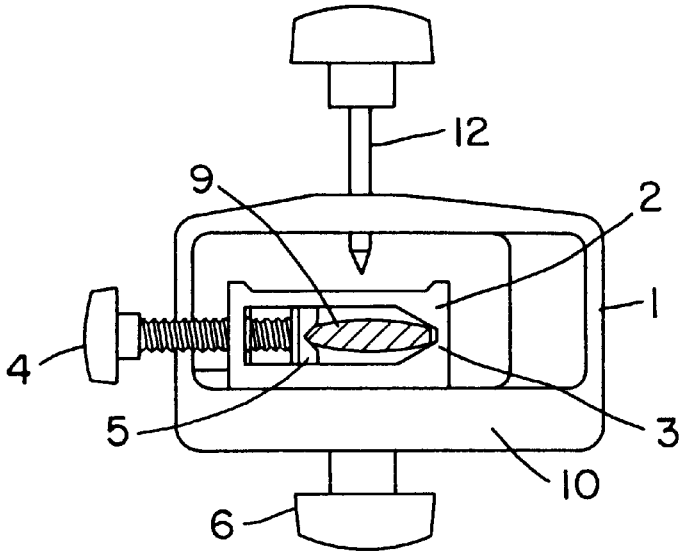
FIG. 1 shows the jig according to the invention including the housing with the casing for firmly holding chisels with an oval cross-section.

FIG. 1 shows an end view of the jig according to the invention, which includes a housing 1 essentially rectangular in cross-section. Housing 1 accommodates a similarly rectangular in cross-section enclosed seat 2, one short side of which is provided with a notch 3. The side opposite the said short side of seat 2 has a screw 4 running all the way through it and threaded in the seat whose inner end is provided with a counterstay 5 that has a notch. The seat 2 can be removed from the housing 1 but can also be locked in place in the housing with the help of a locking screw 6. The treads of the locking screw 6 grip with equivalent threads in a hole 7 (FIG. 4) in the seat and press against the flat inside 8 of housing 1 when locking screw 6 is tightened. The tool 9 is inserted into the seat and is placed with the edges running in notch 3 and the notch of the counterstay 5 and locked in the seat with the help of screw 4. In the situation shown, the seal 2 and thus the tool 9 extend at right angles out from at least the one flat end 10 of the housing. This right-angled position can be taken up automatically by the seat 2 pressing against a shoulder 11 in the passage of the housing 1 when the locking screw 6 is turned around its centre. By loosening the seat 2 from the housing using the locking screw 6, the seat can be turned to the angled position required and once again locked against the housing 1 with the help of the locking screw 6.

As is evident from the following, seat 2 extends somewhat outwards from the flat end 10 of the housing 1.

Figure 2:
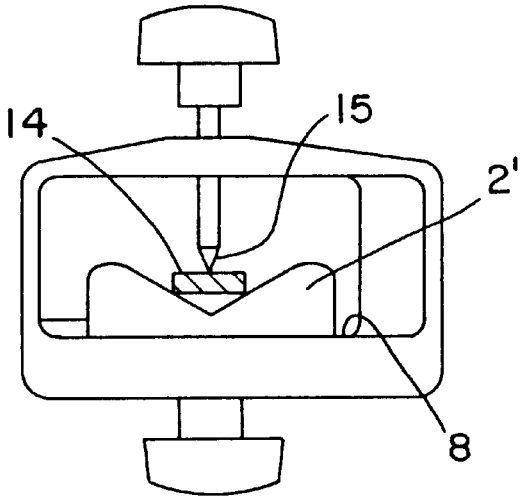
FIG. 2 shows the invention with the open V-shaped seat for grinding tools with straight lips.
Figure 3:
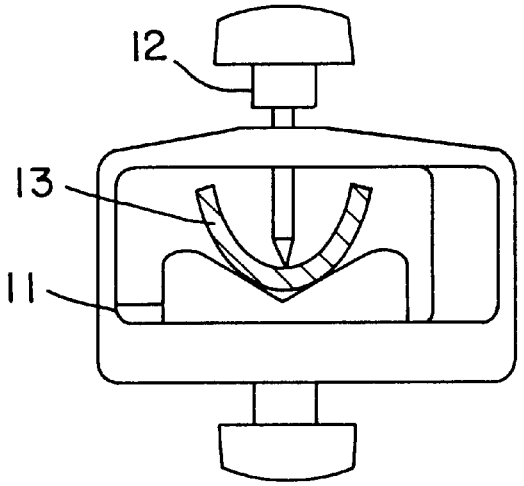
FIG. 3 shows the invention according to FIG. 2 with a firmly clamped gouge.
Figure 4:
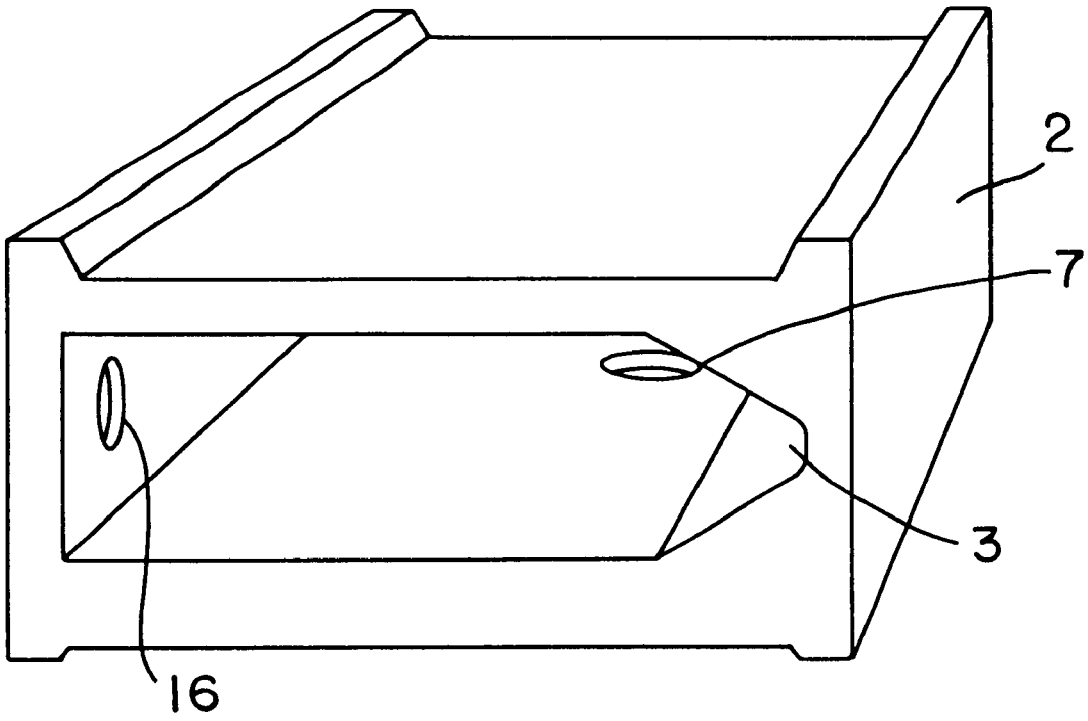
FIG. 4 shows the seat included in the invention in perspective.

FIGS. 2 and 3 show the invention when the enclosed seat 2 has been replaced with an open seat 2'. Like enclosed seat 2, open seat 2' can be turned and locked in position against the flat inside 8 of housing 1. As is evident from FIGS. 2 and 3, open seat 2' has a flattened V-shape. A screw 12 threaded forwards and backwards in housing 1 is directed at the point of the V, i.e. the bottom of the open channel. By using this open seat 2', it is possible with the help of the invention to grind tools such as gouges 13 or parting tools 14 or chisels or similar. As the free end of screw 12 ends in a point this is located co-axially with locking screw 6, it is possible to pivot the seat 2' with the tool in relation to the housing 1. FIG. 4 shows the enclosed seat 2 with a threaded hole 16 for screw 4 and, as previously mentioned, the threaded hole 7 for locking screw 6.

Figure 5:
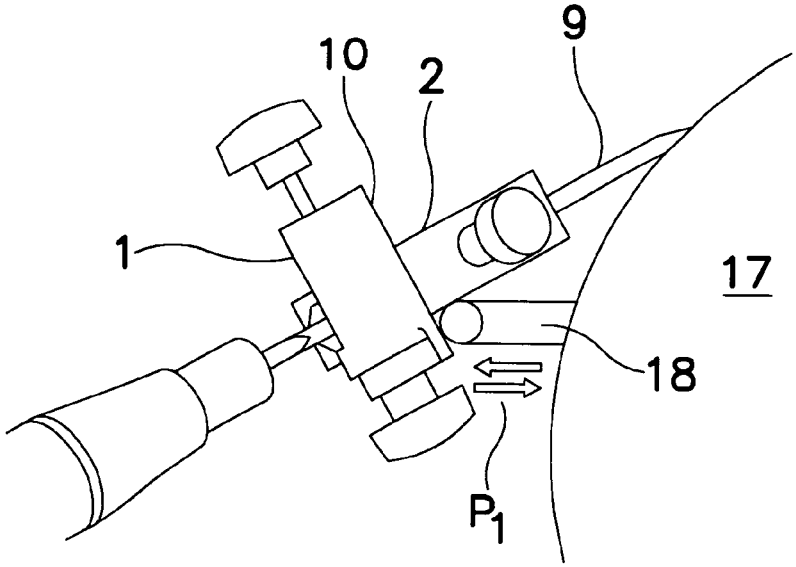
FIGS. 5 and 6 show the invention used for grinding a bevelled chisel with an oval cross-section.
Figure 6:
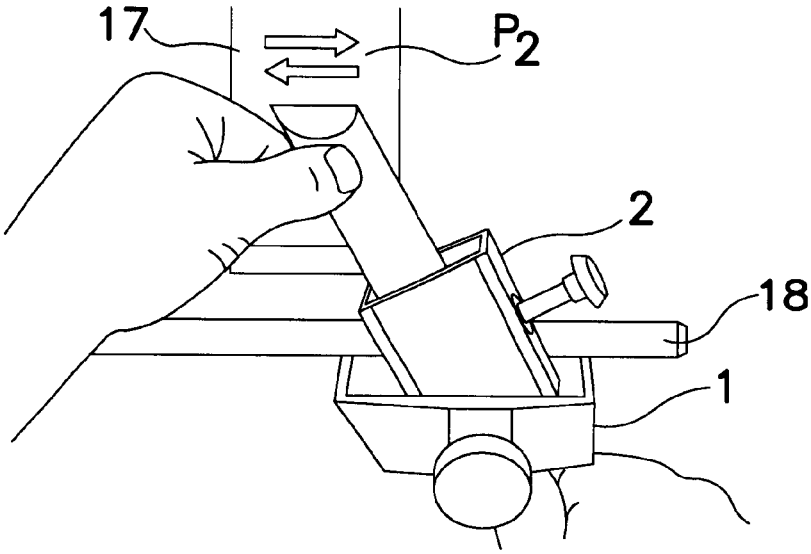

FIGS. 5 and 6 show the grinding of a bevelled chisel with the help of the invention. In the figures, 17 designates a grinding wheel and 18 a so-called universal support which is attached to the base of the grinding wheel and as such is fixed in relation to the rotating grinding wheel. Tool 7 is clamped firmly in housing 1 via seat 2 as described previously and, with the help of the latter, an oblique adjustment of the tool in relation to the housing is set, where the oblique adjustment determines the inclination of the cutting edge. The cutting angle of the tool is determined by displacement of the universal support 18 as indicated by the arrows $P_1$ (FIG. 5). During grinding, the flat and broad end 10 of the housing 1 abuts the universal joint 18 while the jig rests against the support 18 with the "underside" of seat 2, i.e. by being held with the end 10 pressed against the universal support 18, the housing guides the tool the whole time in a straight line movement, see arrows $P_2$ (FIG. 6). To grind the lip on the other side of the tool 9, the whole jig is turned 180°. The tool is held completely symmetrically in seat 2, i.e. at the same distance from both broad ends of the seat, which means that repeating the adjustment for grinding the other side of the lip is not necessary.

Figure 7:
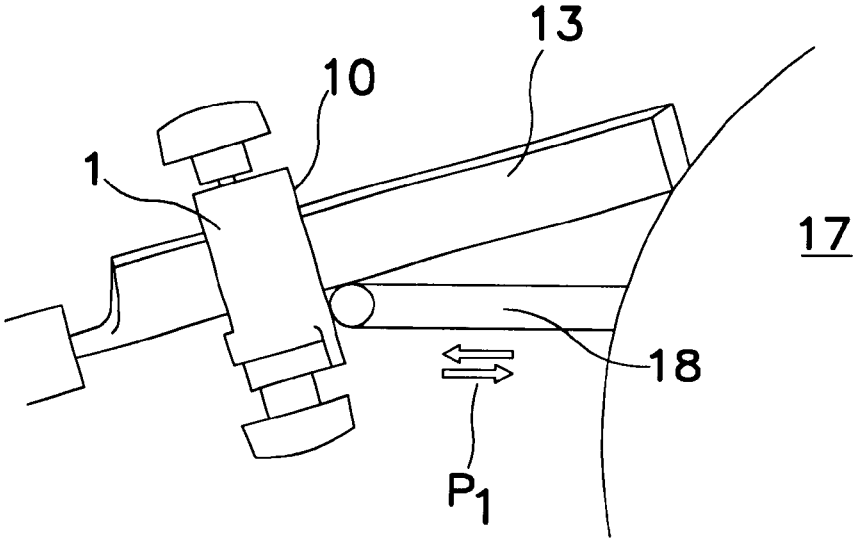
FIGS. 7 and 8 show the invention used for grinding a gouge with a straight lip and with the use of the open seat.
Figure 8:
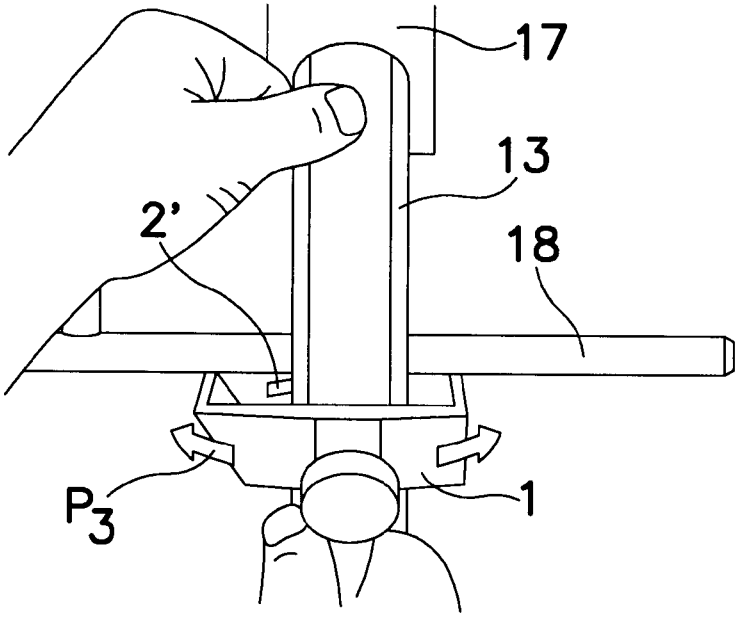

FIGS. 7 and 8 show the grinding of a gouge with the help of the invention. In this case, seat 2' is used, which as is evident from the figures, does not extend outwards from the flat end 10 of housing 1. The gouge is clamped firmly as is shown in FIG. 3. As before, the flat end 10 of the housing 1 is supported against the universal support 18 during grinding, while the underside of the gouge abuts the support 18. During grinding, housing 1 thus guides the direction of the tool 13 towards the grinding wheel 17 while the underside of the gouge makes it possible to tilt the gouge during grinding to thereby grind the whole lip (compare the arrows $P_3$ in FIG. 8. As was mentioned earlier in connection with FIGS. 5 and 6, the angle of cutting is adjusted by displacement of the universal support 18 (arrow $P_1$).

Figure 9:
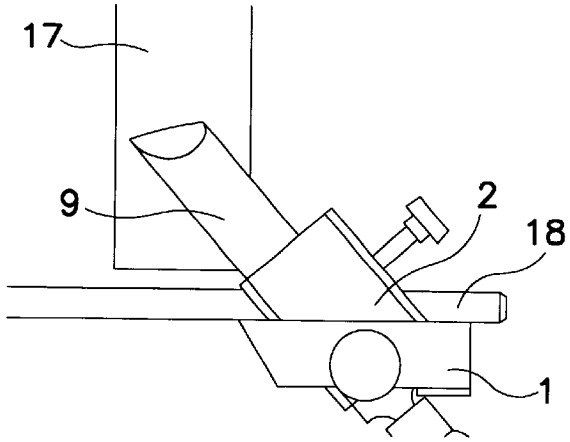
FIGS. 9, 10 and 11 show the invention used for grinding a curved or cam-shaped lip.
Figure 10:
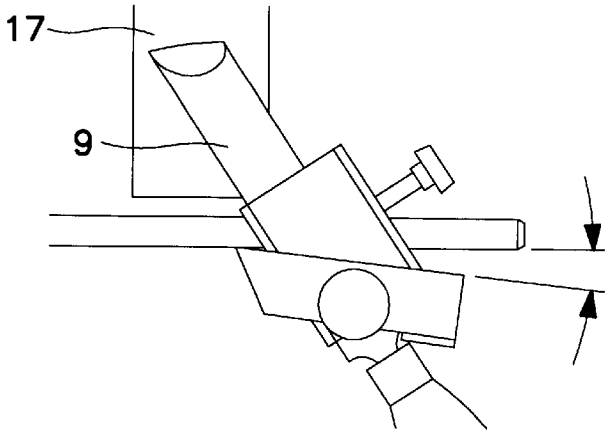
Figure 11:
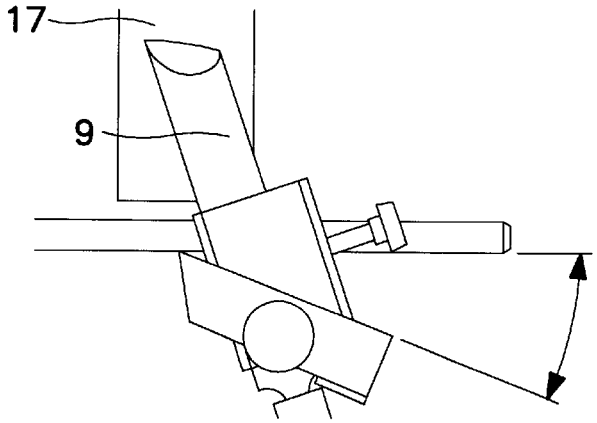

FIGS. 9–11 show how it is possible to grind a lip with a curved or cam-shape with the help of the invention. The tool 9 is clamped firmly in the jig in seat 2 and the starting point is, for example, that shown in FIG. 9. By pivoting the jig against the support 18 around the left-hand edge of the housing at the same time as the jig is displaced with the seat 2 resting against support 18, as in the shown example, the originally straight lip will be ground to a curved shape. By turning the jig with the tool and performing the same movement but in a reverse direction, the other side of the lip of the tool can also be ground.

Figure 12:
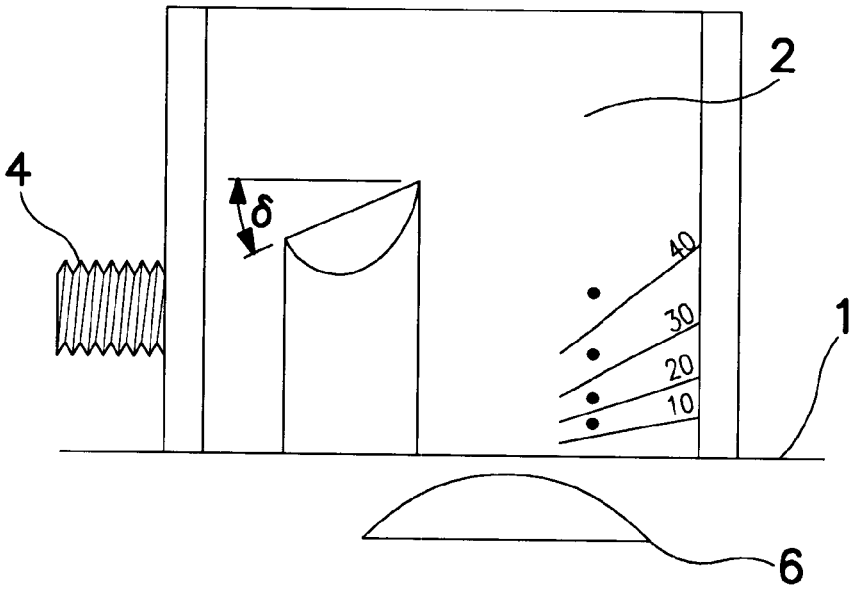
FIG. 12 shows an angle marking on the casing and FIG. 13 shows how the invention with the help of this angle marking can be used when adjusting the inclination of the lip of the tool.
Figure 13:
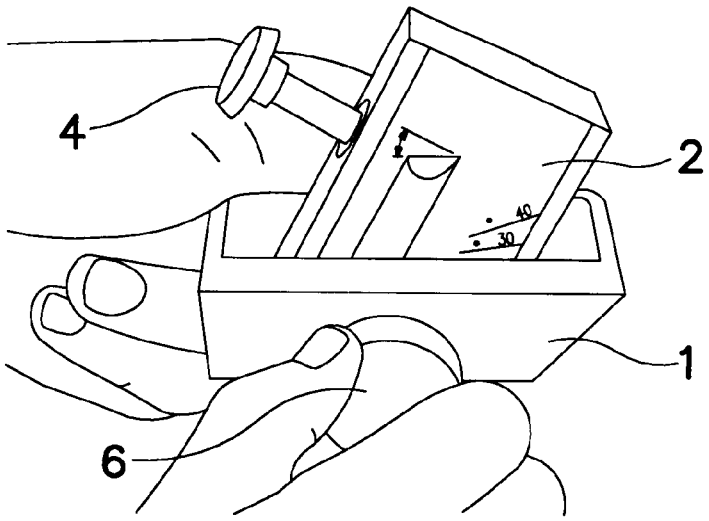

FIG. 12 shows the seat 2 provided with a graduated scale up to 40°, whereby the symbol with the obliquely ground end of a tool and the angle marking δ explain the meaning of the scale. FIG. 13 shows more clearly the seat 2 located in housing 1.

As is shown in the figures, housing 1 is shaped with a narrow side inclined "backwards", i.e. in, a direction towards the operator when handling the jig. The design is conditioned by giving the seat sufficient free-play when being pivoted as well as keeping the housing as small and easy to handle as possible.

What is claimed is:

1. In a jig for grinding sharp-edged tools the improvement which comprises said jig having a housing in the form of a casing having a passage running through it whose at least one end is flat, plus a first seat, also in the form of a casing with a passage running through it, located in the passage of the housing and lockable in said housing in an inclined position in relation to the passage in the housing, whereby the first seat is provided with a clamping device for firmly holding a tool that is to be ground so that it extends through the passage of the first seat and has such a length that one end of it extends out beyond the housing at the flat end of the housing.

2. In a jig for grinding sharp-edged tools the improvement which comprises said jig having a housing in the form of a casing with a passage running through it where at least one end is flat, plus a second seat located in the passage of the housing and having an open channel facing towards the interior of the housing in which the tool that is to be ground is intended to lie and be held in place with the help of a locking device that abuts the tool, and that the second seat can be locked in the passage of the housing.

3. A jig according to claim 2 wherein the passage of the housing has a rectangular cross-section and that the seat can be locked against one long side of the passage as seen in cross-section.

4. The jig according to claim 2 wherein the passage of the seat has a rectangular cross-section whose one short side is provided with a notch and whose other short side supports a screw threaded in the seat whose inner end is provided with a counterstay with a notch, whereby-the tool with its edges running in respective notches is locked in the seat with the help of the screw.

5. The jig according to claim 4 wherein the tool extends along the mid-line of the seat when seen at right angles to the direction of clamping of the tool.

6. The jig according to claim 2 wherein the open channel of the seat has a flattened V-shape and that the tool is held in place in the channel with the help of a screw whose end is directed towards the point of the V and that acts on the tool.

7. The jig according to claim 6 wherein the end of the screw is pointed.

* * * * *